US008071899B2

(12) United States Patent
Lo

(10) Patent No.: US 8,071,899 B2
(45) Date of Patent: Dec. 6, 2011

(54) ELECTRONIC DEVICE WITH KEY ASSEMBLY

(75) Inventor: Wu-Jen Lo, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 329 days.

(21) Appl. No.: 12/426,275

(22) Filed: Apr. 19, 2009

(65) Prior Publication Data

US 2010/0051435 A1 Mar. 4, 2010

(30) Foreign Application Priority Data

Sep. 2, 2008 (CN) ..... 2008 1 0304343

(51) Int. Cl.
*H01H 9/00* (2006.01)

(52) U.S. Cl. ..... 200/296; 200/343; 200/5 A

(58) Field of Classification Search ..... 200/5 A, 200/343, 296
See application file for complete search history.

(56) References Cited

U.S. PATENT DOCUMENTS

| | | | | |
|---|---|---|---|---|
| 6,555,769 | B2 * | 4/2003 | Stefura | 200/5 R |
| 6,570,111 | B2 * | 5/2003 | Nakagawa et al. | 200/343 |
| 7,019,237 | B2 * | 3/2006 | Hong | 200/296 |
| 7,189,932 | B2 * | 3/2007 | Kim | 200/5 R |

* cited by examiner

*Primary Examiner* — Xuong Chung Trans
(74) *Attorney, Agent, or Firm* — Altis Law Group, Inc.

(57) ABSTRACT

An electronic device includes an enclosure accommodating a plurality of electronic elements therein, a circuit board positioned in the enclosure and spaced from the panel, and a key assembly positioned between the panel and the circuit board. The enclosure includes a panel defining an opening. The circuit board includes a plurality of switches. The key assembly includes a plurality of key bodies protruding out from the opening of the panel and movable relative to the panel, and a supporting frame attached to the panel for supporting and fixing the plurality of key bodies. The switches are positioned under the plurality of key bodies. Movement of a portion each of the plurality of key bodies along a first direction allows movement of another portion of each of the key bodies along a second direction perpendicular to the first direction to open or close a corresponding switch.

10 Claims, 5 Drawing Sheets

ELECTRONIC DEVICE WITH KEY ASSEMBLY

BACKGROUND

1. Technical Field

The present disclosure generally relates to electronic devices, and more particularly to a key assembly of an electronic device.

2. Description of Related Art

Electronic devices, such as personal digital assistants (PDA), mobile phones, set-top boxes, for example, often utilize a plurality of keys to control one or more operations thereof. One such frequently used electronic device includes a plurality of switches positioned on a daughterboard to control the one or more operations of the electronic device, a plurality of keys each aligning with the corresponding switch and including a projection projecting from a central bottom thereof to open or close the corresponding switch, and a motherboard electronically connecting to the daughterboard. However production cost of the electronic device is increased by the daughterboard and the connection between the motherboard and the daughterboard, as well as efforts toward minimizing the electronic device profile being compromised.

Therefore, a need exists in the industry to overcome the described limitations.

DETAILED DESCRIPTION

Figure 1:
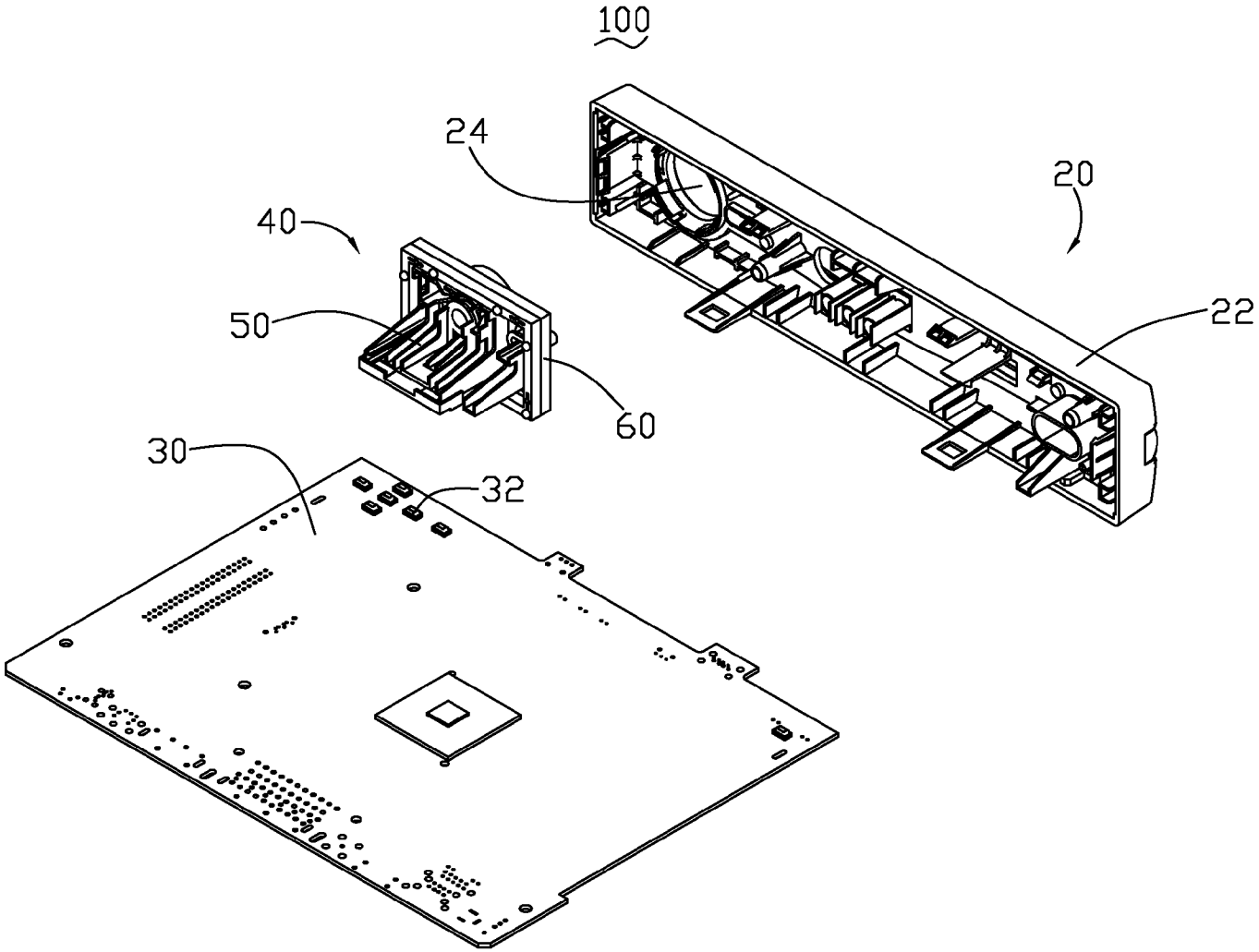
FIG. 1 is an exploded, isometric view of an electronic device of an exemplary embodiment of the disclosure.

FIG. 1 is an exploded, isometric view of an electronic device 100 of an exemplary embodiment of the disclosure. The electronic device 100 includes an enclosure 20, a circuit board 30 mounted in the enclosure 20, and a key assembly 40. The electronic device 100 is disclosed here as a set-top box or a mobile internet device (MID), but the disclosure is not limited thereto.

The enclosure 20 accommodates electronic elements, such as printed circuit boards (PCBs), batteries, a central processing unit (CPU), for example. Although the illustrated embodiment shows the enclosure 20 being substantially rectangular, it will be understood that other configurations may be utilized with equal applicability. The enclosure 20 includes a panel 22 extending along a side of the electronic device 100 to protect the electronic device 100 at the side. The panel 22 defines an opening 24 to receive the key assembly 40.

The circuit board 30 is positioned in the enclosure 20 and spaced from the panel 22. A plurality of switches 32 is positioned on the circuit board 30 to control one or more operations of the electronic device 100. In the illustrated embodiment, the circuit board 30 is a motherboard.

Figure 2:
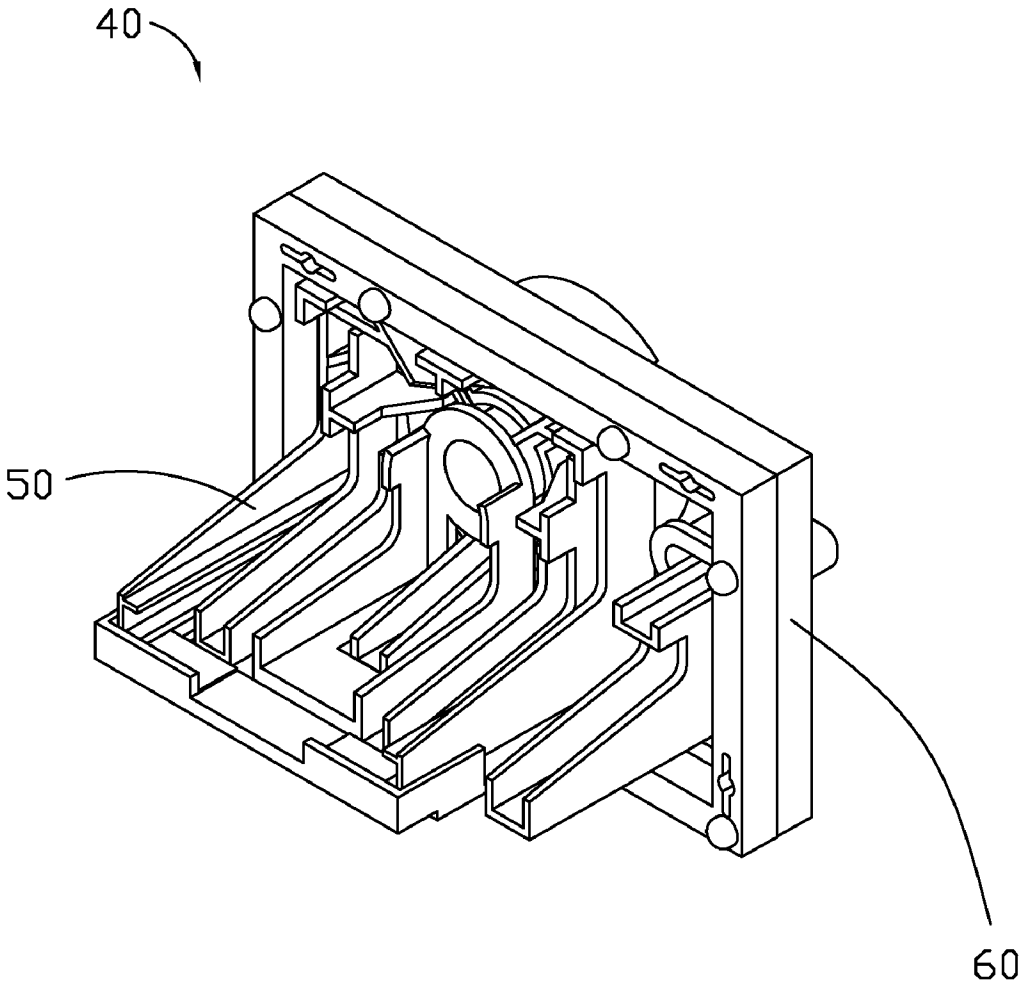
FIG. 2 illustrates an enlarged view of a key assembly of FIG. 1.
Figure 3:
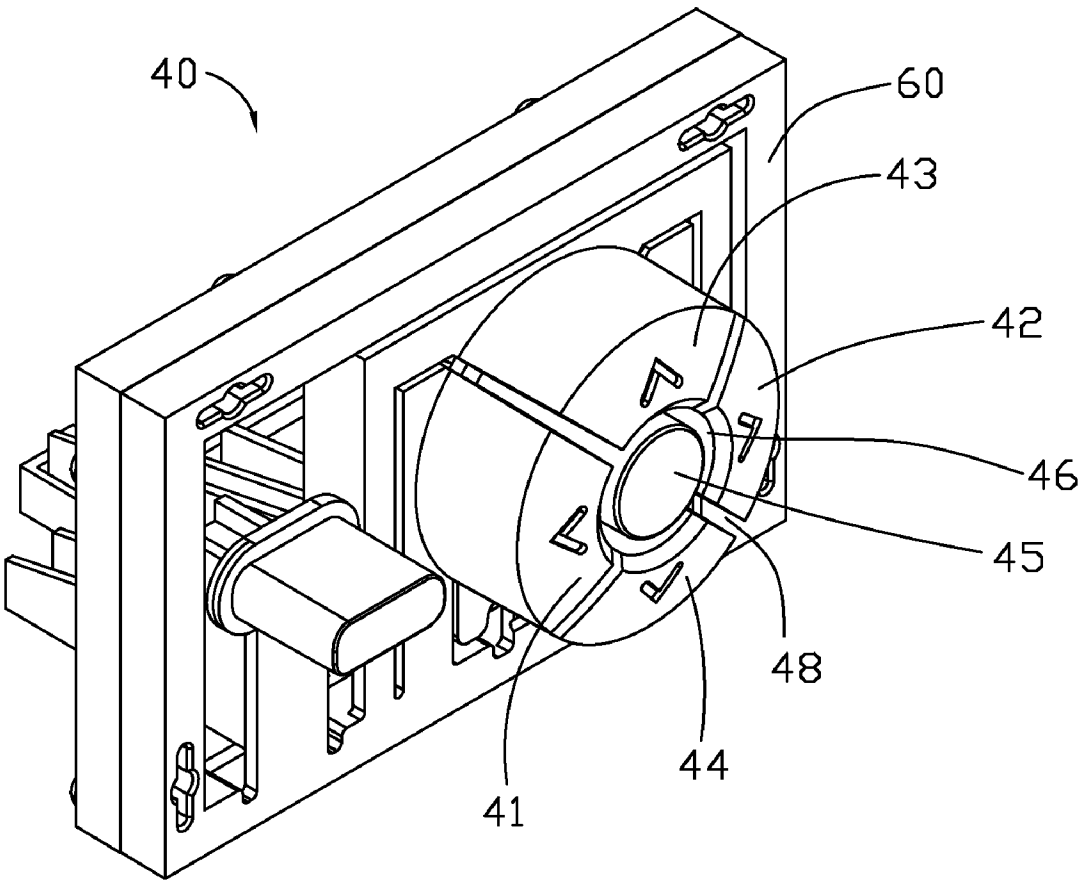
FIG. 3 is similar to FIG. 2, viewed from another aspect.
Figure 4:
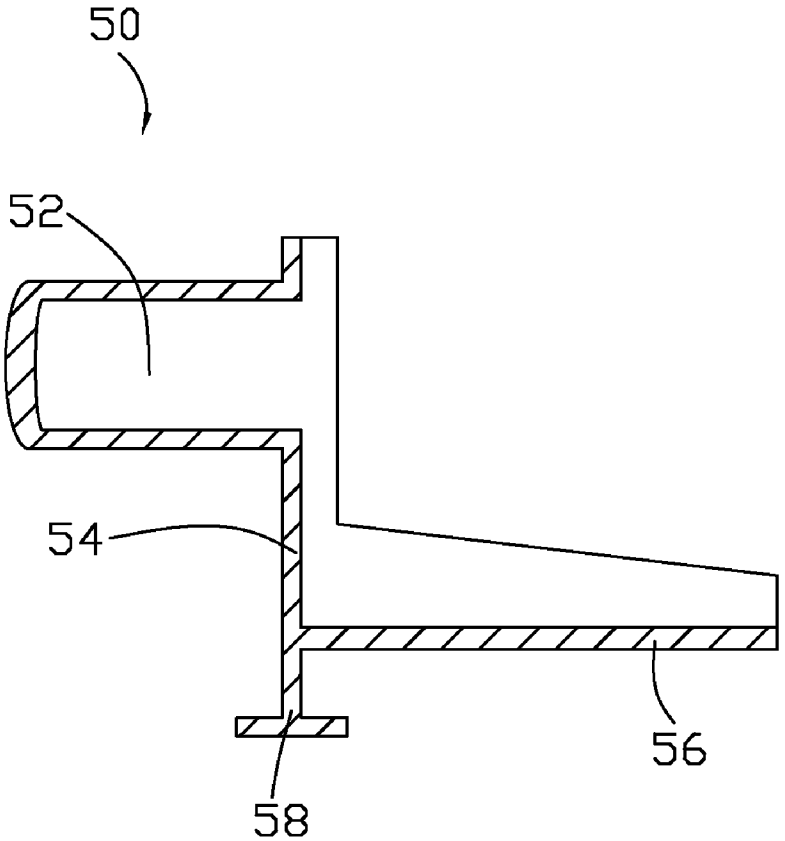
FIG. 4 is cross-section of one key of the key assembly of FIG. 2.

FIGS. 2-3 illustrate an enlarged view of the key assembly 40. FIG. 4 is a cross-section of one key of the key assembly 40. The key assembly 40 is positioned between the panel 22 and the circuit board 30 and includes a plurality of key bodies 50 and a supporting frame 60 attached to the panel 22 of the enclosure 20 to support and fix the plurality of key bodies 50. Although a two-part portion of the key assembly 40 is shown for purpose of illustration, it will be understood that the plurality of key bodies 50 and the supporting frame 60 can also be formed from one or more individual elements assembled to form the key assembly 40.

The plurality of key bodies 50 protrude out from the opening 24 of the panel 22 to an outside of the electronic device 100 and move toward the switches 32 to activate the plurality of switches 32. The plurality of key bodies 50 have four navigational keys, which in one embodiment, may be a left, right, up, and down arrow key 41, 42, 43, 44, and an OK key 45. The four navigation keys bound a circle, in a center of which a circular receiving hole 46 is defined, in which the OK key 45 is received.

Alternatively, the receiving hole 46 may be rectangular. The four navigation keys may further bound an ellipse, rectangle, or other shape.

A gap 48 is defined between each two adjacent navigation keys and between each of the four navigation keys and the OK key 45, preventing any key from interfering with one or more other keys resulting in an erroneous operation of the electronic device 100.

The navigation keys and the OK key 45 have the same configuration. Each of the plurality of key bodies 50 includes a pressing portion 52, a resilient arm 54, a contact portion 56 to open or close the corresponding switch 32, and a fixing portion 58 positioned at a distal end of the arm 54. In the illustrated embodiment, the fixing portion 58 can be attached to the supporting frame 60 by screws, rivets, or other fastening methods known in the art.

The arm 54 is vertically connected to the pressing portion 52 and the contact portion 56. The pressing portion 52 protrudes out from the opening 24 of the panel 22 to the outside of the electronic device 100 and can move relative to the panel 22. Each of the plurality of switches 32 positioned on the circuit board 30 is positioned under a distal end of a corresponding contact portion 56. A central line 520 of the pressing portion is perpendicular to a central line 320 of a corresponding switch 32 (referring to FIG. 5).

In the illustrated embodiment, the arm and the contact portion of the OK key 45 bound a first accommodating space to receive the arm and the contact portion of the left arrow key 41. The arm and the contact portion of the up arrow key 43 bound a second accommodating space to receive the arms and the contact portions of the left arrow key 41, the down arrow key 44, the right arrow key 42, and the OK key 45. The left arrow key 41 and right arrow key 42 are equidistant from the OK key 45. The pressing portions of the left, right, up, and down arrow keys 41, 42, 43, 44 surround the pressing portion of the OK key 45.

Figure 5:
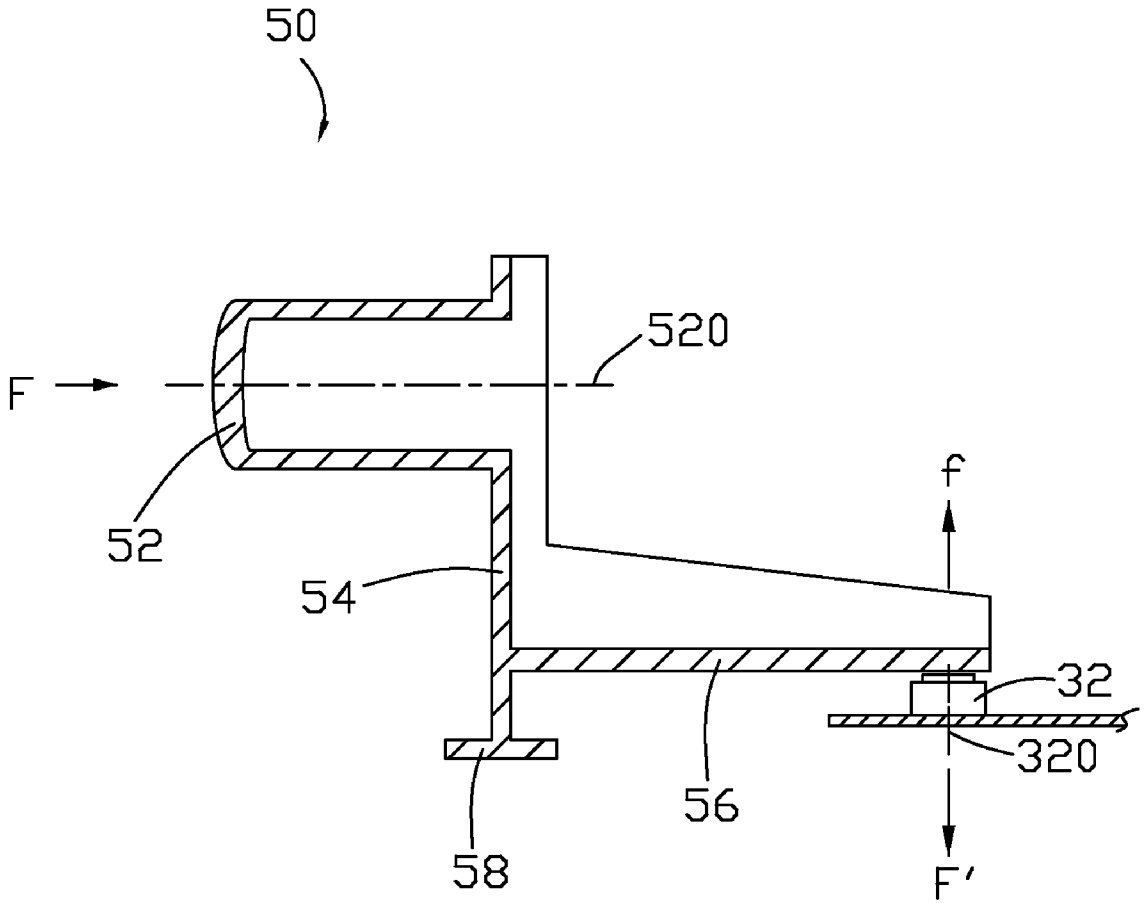
FIG. 5 is a schematic diagram of operation of the key of FIG. 4.

FIG. 5 is a schematic diagram of operation of the key of FIG. 4. When the pressing portion 54 experiences external force F along a first direction, the contact portion 52 rotates slightly about the fixing portion 58 with the distal end of the contact portion 56 moving downward and applying a force F' on the corresponding switch 32 along a second direction perpendicular to the first direction to open or close the switch 32. In other words, the force F applied on the pressing portion 54 can be converted to the force F' that the distal end of the contact portion 56 applies on the switch 32. Thus, the plurality of switches 32 can be directly positioned on the motherboard of the electronic device 100, without an additional circuit board required to position the plurality of switches 32. In addition, the force F applied on the pressing portion 56 and a force f that the switch 32 applies on the distal end of the contact portion 56 are coplanar, avoiding flexing of the key body 50.

Because the plurality of switches 32 is directly positioned on the motherboard of the electronic device 100, the electronic device 100 requires no additional circuit board, with production cost and profile of the electronic device 100 being significantly minimized.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. An electronic device, comprising:

an enclosure accommodating a plurality of electronic elements therein, the enclosure comprising a panel defining an opening;

a circuit board positioned in the enclosure and spaced from the panel, wherein the circuit board comprises a plurality of switches; and a key assembly positioned between the panel and the circuit board, the key assembly comprising a plurality of key bodies protruding out from the opening of the panel and movable relative to the panel, and a supporting frame attached to the panel to support and fix the plurality of key bodies, the plurality of key bodies having four navigational keys and an OK key at a center of a circle bounded by the four navigational keys, a circular receiving hole is defined in the circle to receive the OK key, wherein a gap is defined between each two adjacent navigational keys and between each of the four navigational keys and the OK key, and the plurality of switches are positioned under the plurality of key bodies;

wherein movement of a portion of each of the plurality of key bodies along a first direction allows movement of another portion of each of the plurality of key bodies along a second direction perpendicular to the first direction to open or close the corresponding switch.

2. The electronic device as recited in claim 1, wherein each of the plurality of key bodies comprises a pressing portion protruding out from the opening of the panel and movable relative to the panel, a contact portion to open or close a corresponding switch, an arm vertically connecting to the pressing portion and the contact portion, and a fixing portion fixed on the supporting frame.

3. The electronic device as recited in claim 2, wherein the arm and the contact portion of one of the plurality of key bodies surround other arms and the contact portions.

4. The electronic device as recited in claim 2, wherein the arm and the contact portion of one of the plurality of key bodies are positioned in a center of the key assembly.

5. The electronic device as recited in claim 2, wherein the arm and the contact portion of one of the plurality of key bodies extend into a accommodating space surrounding by the arm and the contact portion of another of the plurality of key bodies.

6. An electronic device, comprising:

a panel extending along a side of the electronic device to protect the electronic device at the side and defining an opening;

a circuit board positioned in the electronic device and spaced from the panel, wherein the panel comprises a plurality of switches; and a key assembly positioned between the panel and the circuit board, the key assembly comprising a plurality of key bodies protruding out from the opening of the panel and movable relative to the panel and a supporting frame attached to the panel to support and fix the plurality of key bodies, the plurality of key bodies having four navigational keys and an OK key at a center of a circle bounded by the four navigational keys, a circular receiving hole is defined in the circle to receive the OK key, wherein a gap is defined between each two adjacent navigational keys and between each of the four navigational keys and the OK key, and the plurality of switches are positioned under the plurality of key bodies;

wherein a force applied on any one of the plurality of key bodies along a first direction can be converted to a force along a second direction perpendicular to the first direction to open or close a corresponding switch.

7. The electronic device as recited in claim 6, wherein each of the plurality of key bodies comprises a pressing portion protruding out from the opening of the panel and movable relative to the panel, a contact portion to open or close the corresponding switch, an arm vertically connecting to the pressing portion and the contact portion, a fixing portion fixed on the supporting frame.

8. The electronic device as recited in claim 7, wherein the arm and the contact portion of one of the plurality of key bodies surround other arms and the contact portions.

9. The electronic device as recited in claim 7, wherein the arm and the contact portion of one of the plurality of key bodies are positioned in a center of the key assembly.

10. The electronic device as recited in claim 7, wherein the arm and the contact portion of one of the plurality of key bodies extend into a accommodating space surrounding by the arm and the contact portion of another of the plurality of key bodies.

* * * * *